United States Patent [19]

Hunt

[11] 4,264,007

[45] Apr. 28, 1981

[54] CONTAINER HAVING SEPARATE STORAGE FACILITIES FOR TWO MATERIALS

[75] Inventor: Guilbert M. Hunt, Brecksville, Ohio

[73] Assignee: General Foods Corporation, White Plains, N.Y.

[21] Appl. No.: 87,247

[22] Filed: Oct. 22, 1979

Related U.S. Application Data

[62] Division of Ser. No. 917,261, Jun. 20, 1978, Pat. No. 4,221,291.

[51] Int. Cl.[3] ..... B65D 25/08

[52] U.S. Cl. ..... 206/219; 220/23; 215/6; 206/222

[58] Field of Search ..... 206/219, 222; 215/6; 220/23

[56] References Cited

U.S. PATENT DOCUMENTS

| | | | |
|---|---|---|---|
| 2,965,496 | 12/1960 | Serdar | 220/23 X |
| 3,743,520 | 7/1973 | Croner | 220/23 X |
| 4,141,468 | 2/1979 | Funaro | 206/219 X |

*Primary Examiner*—George T. Hall

*Attorney, Agent, or Firm*—Daniel J. Donovan; Bruno P. Struzzi

[57] ABSTRACT

A container providing for the separate storage of two materials and the admixing of the materials upon opening of the container. A main container holds a quantity of a first material, such as carbonated water, and a separate compartment holds a small quantity of a second material, such as a dipeptide sweetener flavoring. The disclosure provides several embodiments of the invention wherein a bottle has a compartmented closure applied as a cap thereto. The closure incorporates a compartment, which may be substantially cylindrically shaped, for the second material, and has a flexible top wall and a releasable bottom wall which is positioned within the neck of the bottle. An actuating rod extends through the compartment intermediate the flexible top wall to the releasable bottom wall whereby, when it is desired to admix the first and second materials, the flexible top wall is pressed down to force the actuating rod against the releasable bottom wall, thereby causing it to pivot open and release the second material within the compartment to admix with the first material in the bottle. In another embodiment of the invention the container is a can having a pull-top type opener, and in which a separate compartment in the shape of a cup is attached to the bottom of the can top closure beneath the pull-top opener and a dispensing orifice covered by the opener. As the pull-top opener is pulled open, the separate compartment tilts away from the can top closure into the container thereby releasing the second material into the can while freeing the dispensing orifice.

8 Claims, 8 Drawing Figures

CONTAINER HAVING SEPARATE STORAGE FACILITIES FOR TWO MATERIALS

This is a division of application Ser. No. 917,261, filed June 20, 1978 now U.S. Pat. No. 4,221,291.

BACKGROUND OF THE INVENTION

1. Field of the Invention

The present invention relates, in general, to containers and, more particularly, pertains to containers having separate compartments in which several ingredients of a product may be stored separately until it is desired to admix them, at which time it is possible to establish communication between the compartments so that the separated ingredients may be admixed prior to dispensing of the product from the containers.

Containers of this type are useful for the separate storage of ingredients or materials for a variety of products, and have particular applicability to the fields of pharmaceuticals and cosmetics, for instance, where at least two ingredients can be stored separately for reasonably lengthy periods of time, but if admixed will produce a product which deteriorates rather rapidly. Such products usually, but not necessarily, comprise at least one liquid ingredient and one other ingredient which may be either in the form of a liquid or in the form of dry granules or powder.

Other fields of application in which such containers may find utility are in the separate storage and predispensing addition of color pigments to paints, the admixing of catalysts and chemical compounds (e.g., epoxy cements), the combination of different chemicals in order to produce desired reactions (e.g., multicomponent foam systems), and unstable colorants such as naturally-occurring colors.

Another important field of use for containers of this type lies in the storage of foodstuffs and particularly beverages. Thus, a new flavoring constituted of dry ingredients, and being in the form of granular material or a powder may have been developed for carbonated beverages which has significant potential consumer appeal in comparison with existing products, with the beverage, however, having a limited shelf life after the flavoring is mixed with liquid or carbonated water present in the container. The flavoring has a lengthier shelf life when maintained in a dry condition and separate from the water or liquid, and with the product being more flavorful and marketable when stored in a container which maintains the flavoring and carbonated water in separate compartments and inaccessible to each other until opening of the container for the purpose of dispensing the beverage.

2. Discussion of the Prior Art

At present, the prior art discloses various containers or receptacles for the separate storage of various materials or ingredients of a product adapted to be admixed prior to dispensing from the containers.

Nosik U.S. Pat. No. 2,721,522; Bowes et al U.S. Pat. No. 3,156,369; Magni U.S. Pat. No. 3,603,469; Morane U.S. Pat. No. 3,802,604; Lanfranconi et al U.S. Pat. No. 3,840,136 and Cavazza U.S. Pat. No. 3,968,872 each disclose multicompartmented containers for the separate storage of various materials or ingredients of a product adapted to be admixed prior to dispensing from the containers. Each of these patents discloses a type of container in the shape of a bottle, can, or the like wherein a frangible member is adapted to be severed or ruptured by the depression of a plunger so as to dispense a material stored in a compartment within the neck of the bottle or container into a liquid which is located in the container. However, severance of the frangible member is caused by relatively complex and cumbersome mechanisms or actuators in the prior art patents, thereby rendering them unattractive from an economical standpoint. Moreover, in various of the earlier patents, such as in Nosik and Morane, there is encountered the drawback of portions of the closure forming loose debris in the containers subsequent to opening of the latter, which will render the containers unattractive and possibly unsanitary from a consumer standpoint.

Gil de Lloret U.S. Pat. No. 3,779,372 discloses a type of container storing a first material which includes a pull-top opener and in which a compartment for the separate storage of a second material is positioned beneath the top closure of the container. Thus, when imparting a pull to the opener to provide access to the contents of the container, a piercing lever is caused to rotate downwardly into engagement with a frangible bottom wall of the compartment, thereby rupturing the wall and releasing the material stored in the separate compartment to admix with the first material in the container. The entire top of the container, including the separate compartment, may then be removed from the container leaving a kind of open drinking cup structure.

SUMMARY OF THE INVENTION

Accordingly, the present invention contemplates the provision of an improved and unique container having an arrangement for separately storing several materials or ingredients of a product within a container prior to opening of the container and which, upon opening of the container, provides for the automatic and practically instantaneous admixing of the separately stored materials prior to being dispensed therefrom.

In accordance with various embodiments of the invention, there is disclosed a container for storing a first material, preferably a liquid such as carbonated water, which container has an outlet orifice or access aperture permitting access to and dispensing of its contents. A closure is provided for the container aperture, and includes a compartment therein adapted to depend into the container orifice for separately storing a second material. The closure structure incorporates a releasable wall formed in the end of the compartment depending into the container and a flexible or resilient wall at the top end of the compartment or closure. An actuating rod extends centrally through the compartment intermediate the releasable wall and the flexible wall, the arrangement being such that the flexible wall on the closure can be depressed so as to impel the actuating rod against the releasable wall to thereby at least partially separate the releasable wall from the other compartment walls and release the material stored in the compartment into the material stored in the container. Furthermore, the disclosed embodiment contemplates the container being in the shape of a bottle having a neck portion extending between the outlet orifice and container interior, and wherein the closure is of the bottle cap type, the compartment being cylindrically shaped, positioned to depend at least partially into the neck in close conformance with the inner diameter thereof and with the releasable wall being innermostly located in the bottle neck. Moreover, in the disclosed embodiment, the actuating rod is integrally formed with or connected to the releasable compartment wall. Furthermore, the disclosed embodiment provides structure in which the closure is formed of inner and outer members, with the inner member comprising the releasable wall, the actuating rod and the cylindrical side walls of the compartment extending over the lip of the bottle neck, and with the outer member comprising the top flexible wall and bottle neck-engaging flange of the closure.

In another embodiment of the invention, there is disclosed an arrangement wherein a container for storing a first material, preferably in the shape of a cylindrical can, has a top closure surface with a pull-top opener attached to the latter. A compartment for separately storing a second material is attached to the top closure interiorly of the container and is operatively connected to the pull-top opener. Upon opening of the container by means of the pull-top opener, the compartment tilts downward to dispense the second material in the compartment into the container and admix with the first material. Moreover, in the disclosed embodiment of the invention, the container is a can of which the top closure forms one wall surface of the compartment. Furthermore, the compartment is coupled to the pull-top opener in a manner so that upward pull on the latter will tilt the compartment downwardly into the container so as to empty the second material stored therein into the first material stored in the container for almost instantaneous admixing therewith.

Accordingly, it is a primary object of the present invention to provide a novel arrangement for separately storing several materials in a container prior to opening of the container and admix the materials within the container prior to opening of the latter.

Another object of the present invention is to provide an arrangement of the type described incorporating a cap or pull-top type of closure on a container which provides for the admixing of several separately stored materials in the container prior to dispensing thereof from the container.

A more specific object of the present invention lies in the provision of an arrangement of the type described, particularly a container which is adapted to separately store a liquid beverage, such as carbonated water, and a flavoring therefor, including structure for separating the constituents by a liquid-impermeable barrier, an actuating element for causing the flavoring to admix with the liquid when the container is opened but prior to being dispensed therefrom; a convenience type opening such as a pull-top can lid or pilferproof bottle cap; and which will allow for utilization of a standard size beverage can or bottle; which will require little or no modification of a standard container whereby any increase in container cost is minimal; will pour easily when opened; will not contain loose debris from the barrier after opening; and will be compatible with standard carbonated beverage filling and sealing equipment, with the possible exception that special provisions may be required to fill the powder into its compartment in the container.

BRIEF DESCRIPTION OF THE DRAWINGS

The foregoing and other objects and advantages of the inventive container constructed pursuant to the teachings of the present invention may be more readily understood by one skilled in the art, having reference to the following detailed description of preferred embodiments thereof, taken in conjunction with the accompanying drawings, in which.

DETAILED DESCRIPTION OF THE DRAWINGS

Figure 1:
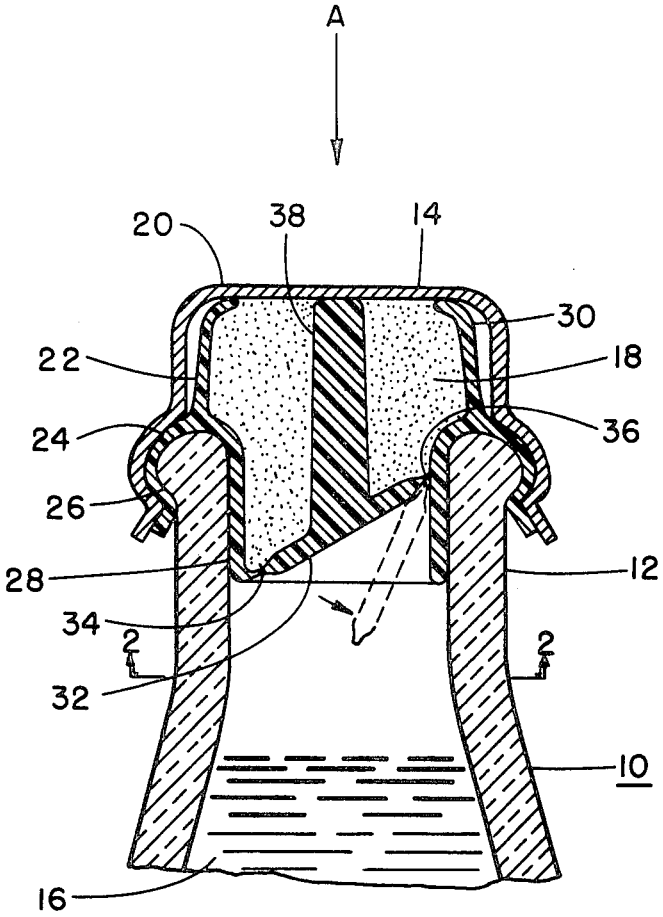
FIG. 1 illustrates an elevational section through a first embodiment of the invention wherein a bottle-shaped container is provided with an inventive cap closure having a closed compartment therein for the storage of a material adapted to be admixed with another material in the container.
Figure 2:
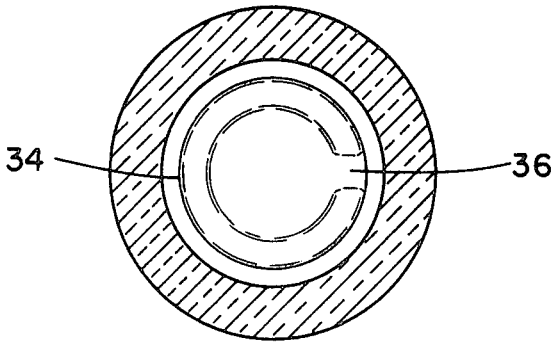
FIG. 2 is a section taken along line 2—2 in FIG. 1.

Referring now in detail to the drawings, in FIG. 1 there is illustrated a first embodiment of the invention wherein a container 10 in the shape of a bottle has a bottle cap closure 14 applied to the top of its neck 12. The container may be a standard commercial bottle formed of glass or plastic, and is adapted to hold a first material 16 therein, preferably a liquid such as carbonated water. The closure 14 has a substantially cylindrically shaped compartment located therein which contains a second material 18. The second material 18 may be a flavoring for the carbonated water, such as a dipeptide sweetener in either granular or pulverulent form. It is desirable to separately store the dipeptide sweetener from the carbonated water since the dipeptide sweetener undergoes a hydrolysis reaction after being admixed with water, which imparts a limited shelf life to the mixture after admixing thereof. The closure 14 is formed of an outer member 20 which has a flexible or resiliently deformable top surface or crown and substantially cylindrically shaped side walls or flange which closely covers an inner compartment-forming member 22 which has an obliquely sloped bottom wall surface and substantially cylindrically shaped side walls. The outer member 20 may be formed of any flexible or resiliently yieldable material such as plastic or a thin metal. The inner member 22 includes a flange portion 24 which extends over a beaded lip 26 formed at the top of the bottle neck 12 to securely fasten the closure 14 to the bottle. A first portion of the compartment containing the second material 18 extends into the neck 12 of the bottle in the form of a sleeve 28 in close contact with the inner wall surface of the bottle neck, while a second sleeve-like portion 30 of the compartment projects above the neck of the bottle into engagement with the inner surface of the cap crown. In modifications of this embodiment of the invention, the compartment might extend to a greater or lesser degree into the neck of the bottle. The sloped bottom wall 32 of the compartment is formed with a weakened annular wall section 34 extending almost entirely around its entire circumference proximate its attachment to sleeve 28 with the exception of a small tab portion 36 which is constituted of a slightly heavier thickness than the weakened wall portion. The bottom wall 32 of the compartment has an actuating rod 38 connected thereto or integrally formed therewith which extends generally vertically upwardly through the compartment to the upper end thereof into contact with the lower or inner crown surface of the outer member 20. The inner member 22 may be formed of various types of materials and, preferably, is formed of molded plastic. The outer member 20 fits snugly over the inner member 22 in the region extending over the bottle lip 26 so as to form a pressure-tight seal structure.

The arrangement is such that a consumer may press down on the top surface of the closure cap crown in the direction of arrow A, thereby causing the top surface to deflect downwardly and, resultingly, displace the actuating rod 38 downwardly in conjunction with the bottom wall 32 of the compartment. The force is sufficient to cause severance of the bottom wall 32 from sleeve portion 28 along its annular weakened wall section 34 thereby opening the compartment and allowing the second material 18 in the compartment to empty into the first material 16 in the container 10. The tab portion 36 prevents the bottom wall 32 from completely separating from the remainder of the inner member 22 and falling into the container. The force exerted against the flexible top surface is also adequate to contain any added pressure acting against the top wall which may be encountered by the release of pressurized gas from the container into the compartment.

Figure 4:
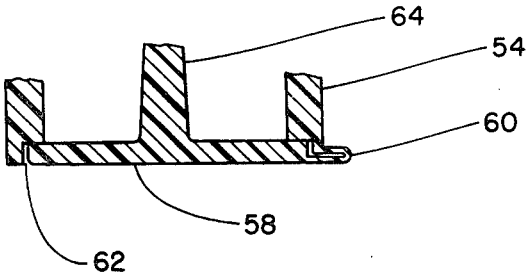
FIG. 4 is an enlarged fragmentary sectional view of the closure shown in FIG. 3.
Figure 3:
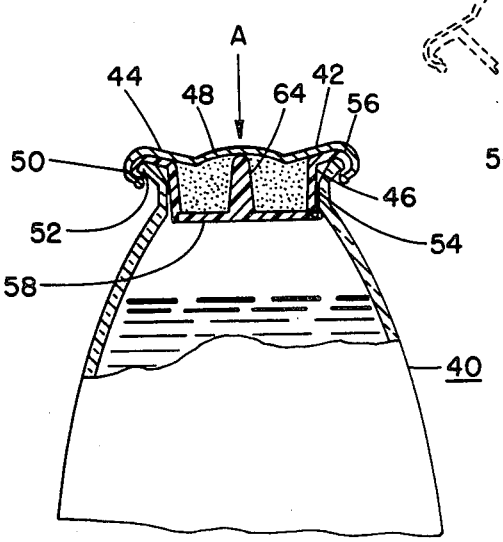
FIG. 3 illustrates a view, partly in section, of another embodiment of the invention.
Figure 5:
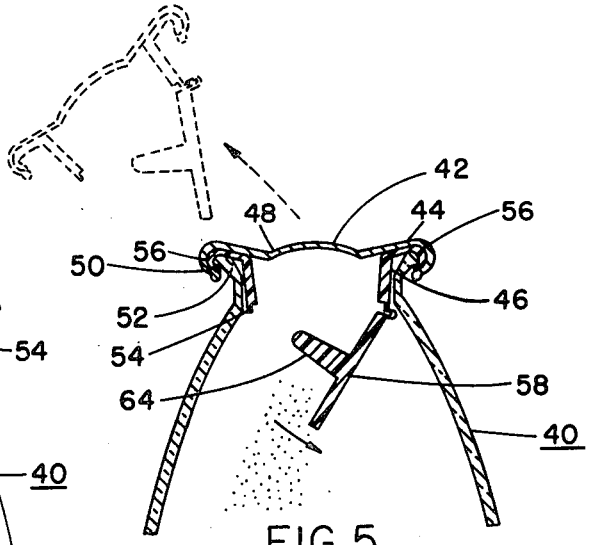
FIG. 5 shows a sectional view of the closure of FIG. 3 with the compartment therein in an opened condition.

FIGS. 3, 4 and 5 illustrate a second embodiment of the invention in the shape of a wide-mouth jar or bottle 40 which, as in the previous instance, may be formed of glass or plastic. A peel- or pry-off closure 42 includes an outer portion 44 and an inner portion 46. The outer portion 44 includes a flexible or resiliently yieldable top wall 48 and a flanged rim section 50 which curves down and about in close engagement with the lip 52 of the container so as to seal the closure to the container. The outer portion 44 may be formed of a relatively soft flexible or pliable material such as aluminum foil which will permit its removal from the container without the need for an opener. The inner portion 46 includes a generally cylindrical side wall 54, the upper portion 56 of which curves upwardly and outwardly over the lip 52 of the container and below the flanged rim section 50 to form a pressure-tight seal between the top of the bottle 40 and the outer member 44. The inner portion 46 also includes a releasable bottom wall 58, as shown in enlarged detail in FIG. 4 of the drawings. Wall 58 is hinged at one edge 60 to the cylindrical side wall 54 at the lower end thereof, as shown in FIG. 5. Bottom wall 58 fits into an annular recess 62 formed in the bottom of the side wall, and may be held in that position closing the compartment by either being force-fitted into recess 62 or, alternatively, held in place by a suitable adhesive. The inner portion 46 also includes an actuating rod 64 which is connected to or formed integrally with the releasable bottom wall 58 and which extends upwardly through and centrally of the compartment into contact with the lower surface at the center of the flexible top wall or bottle cover 48.

When a consumer wishes to use the contents of the apparatus, the consumer presses down on the center of the top cover wall 48, in the direction of arrow A, thereby flexing the wall downwardly and, resultingly, concurrently downwardly displacing the actuating rod 64, thereby causing the bottom wall 58 to pivot downwardly, as shown in FIG. 5, about hinge 60 integrally joining it to side wall 54, and to release the contents of the compartment into the container and admix with the contents of the latter. After the contents of the compartment have been released into the container, the entire closure, including the inner and outer portions thereof, may be peeled off the top of the container and removed as indicated by the phantom lines in FIG. 5. If it is desired to reclose the bottle, the bottom wall 58 together with actuator rod 64 may be detached from the closure structure, i.e. by twisting off at hinge 60, and discarded. The remaining closure structure can then be readily snapped onto the lip of the bottle.

Figure 6:
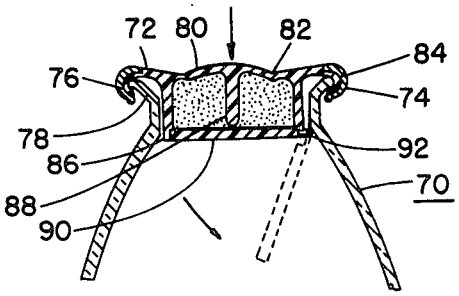
FIG. 6 is a sectional view of another embodiment of the invention illustrating a closure differing from that shown in FIG. 3.

FIG. 6 illustrates still another embodiment of the invention which is basically similar in operation to that shown in FIGS. 3 to 5. The container 70 is the same type of wide-mouth jar or bottle, suitably formed of glass or plastic, however, the closure 72 is formed somewhat differently. The outer closure portion 74 now comprises an annular rolled flange sealing member 76 which extends about and over a lip 78 formed at the top or orifice of the bottle. The function of the outer portion 74, in this embodiment, is primarily to seal the closure to the bottle.

The outer portion may be formed of various types of materials, with a suitable material being a soft metal, such as aluminum or aluminum foil. The inner closure portion 80 includes structure for forming the complete compartment, including a flexible or resiliently yieldable top wall 82, an annular or toroidal flanged sealing portion 84 which extends below the annular outer portion 74 so as to complete the seal with the lip 78 of the bottle 70. A cylindrical side wall 86 which is integrally formed with portion 80 extends into the neck portion of the bottle in proximity to the inner wall thereof. An actuating rod 88 is formed integrally with the center of the top wall portion 82 and depends downwardly therefrom into contact with a horizontal bottom wall 90. A flexible hinge 92 connects one edge portion of bottom wall 90 to the lower end of side wall 86 in a manner adapted to form a closed compartment, in effect, either force-fitted into a recess provided in the bottom of the side wall 86, or adhesively fastened thereto. Inner member 74 may be formed of various materials, with one suitable construction being of molded plastic. In one alternative modification of this embodiment, the releasable bottom wall 90 may be formed of a thin rupturable film, such as aluminum foil, which will readily rupture upon force being applied thereto by the actuating rod 88. The embodiment of the invention shown in FIG. 6 provides for an arrangement which operates in much the same manner as that illustrated in FIGS. 3 to 5 of the drawings.

The embodiments of the invention described thus far have a number of advantages over known prior art constructions. Thus, the closure is of a simple construction which may be easily formed or molded from two pieces of material. The compartment in the closure may be readily filled with a product ingredient, and the compartment sealed by interfitting the two segments of the closure prior to the latter being mounted on the container. If the container holds carbonated water, the initial depression of the closure top surface so as to open the compartment and release its contents into the container confines the release of carbon dioxide which occurs upon occasion when a carbonated beverage container is opened. The entire closure may be removed from the container without leaving behind any remnants or residue in the container. Further, the contents of the compartment are released into the container past the neck of the container whereby, if the container is imbibed from directly, no residue of the second material is found around the opening or bottle orifice which will be directly contacted by the lips. Moreover, the closure is a type which may be reapplied so as to reseal the container.

Figure 8:
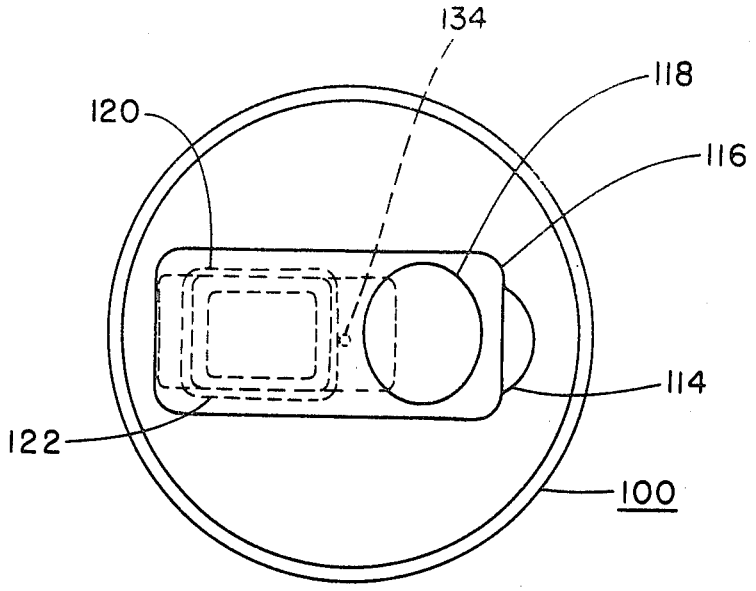
FIG. 8 is a top plan view of the container of FIG. 7.
Figure 7:
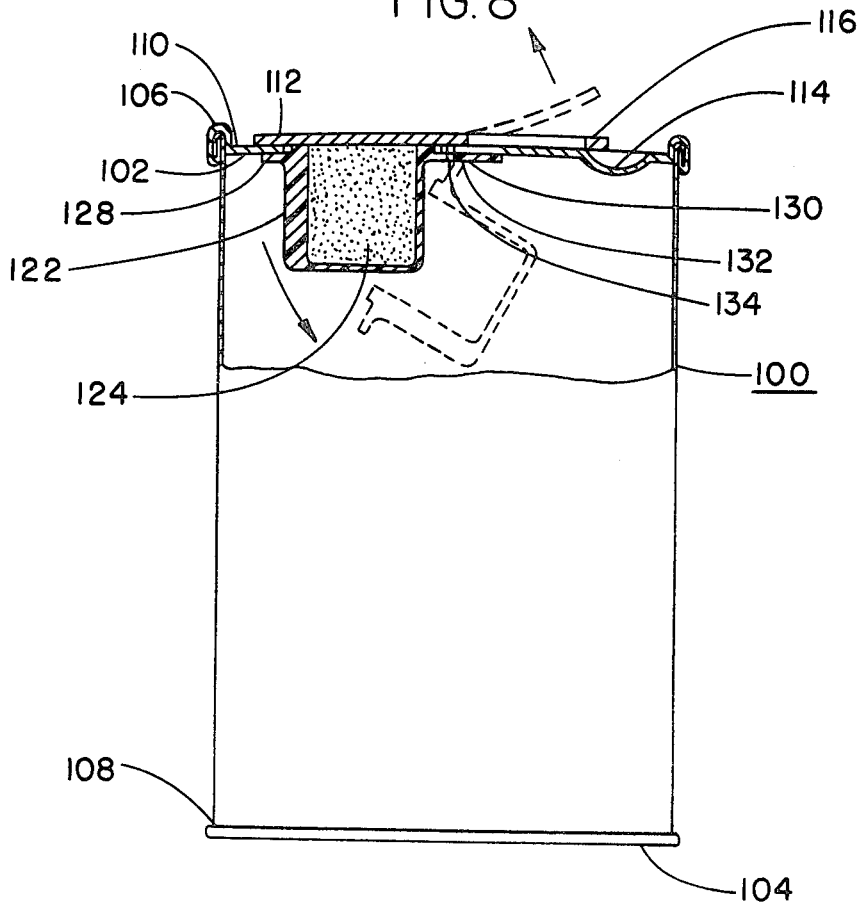
FIG. 7 is an elevational sectional view of another embodiment of the invention wherein the container is of a cylindrical can-shape having a pull-top opener which is operatively connected to a compartment mounted beneath the can top interiorly of the container and in which the contents of the compartment are adapted to be released into the contents of the can upon activation of the pull-top opener.

FIGS. 7 and 8 illustrate a further embodiment of the present invention. A container in the form of a cylindrical can 100 has relatively flat top and bottom closures 102 and 104 which are crimped around their edges at 106 and 108 to sealingly fasten them to the cylindrical wall of the container. The container may also be soldered at 106 and 108 to provide a more effective seal. The outer surface 110 of the top closure 102 has a pull-top opener 112 attached thereto. A small depression 114 formed in the top of the can closure 102 allows a consumer convenient gripping access to a pull-tab 116 on the opener 112 when it is desired to open the container, and an aperture 118 in the opener which permits the consumer to firmly grasp the opener. The opener 112 extends over and seals off a round-cornered rectangular access aperture 120 formed in the top closure 102 of the can. The body and/or closures of the can may be formed of any suitable material, such as aluminum or steel. A compartment in the form of a cup 122 is filled with an ingredient 124 adapted to be eventually admixed with the contents of the can, and the cup 122 is fastened, as by a releasable glue, along its rim portion to the inner wall surface of opener 112 facing the can top closure 102. The area defined by the side walls of the cup is smaller than the aperture 120 formed in the top closure 102 of the can above the location of the cup and, accordingly, the main portion of the cup is held in place only by adherence to the surface of the opener 112, a flange portion 128 and a handle section 130 on the cup upper rim preventing movement out of the aperture 120. The handle section 130 of the cup is attached directly to the inner surface of the top closure of the can and not to the opener. When the pull tab 116 is utilized for opening of the can, it is peeled off the top of the main portion of the cup, thus freeing the latter from contact therewith. The handle section 130 may include a ridge or hinge line 132 which will bias the main portion of the cup to tilt downwardly at an angle relative to the remainder of the handle upon the cup being freed from adherence to the opener 112. Upon release of the cup, the cup is biased down, as shown by the phantom lines in FIG. 7, to assume a downwardly inclined position in which its contents are released into the container so as to admix with the contents in the latter. The top closure 102 of the can is also provided with a small pressure release aperture 134 which allows pressurized gas in the can to be vented preceding the opening of the access aperture 120 and release of the contents of cup 122. The pressure release aperture 134 is normally covered and sealed by the pull-tab opener 112. As the opener 112 is pulled off, the pressure release aperture 134 is vented prior to opening of the access aperture 120, which allows any excess pressure in the container to be released prior to opening of access aperture 120. This feature prevents vented gas from the container from entraining material contained in the cup 122 from being blown out of the container. The top closure 102 and opener 112 may be formed of metal, with aluminum being particularly suitable, and the cup 122 may be constituted of plastic. The embodiment of the invention shown in FIGS. 7 and 8 has a number of advantages over known prior art constructions, including the following: The top of the can may be relatively easily manufactured from three pieces; the top closure, the pull-top opener and the cup. The cup may be filled prior to being assembled with the top closure and the three-piece assembly may then be easily applied to a standard can body. After removal of the opener, the access opening in the can top closure becomes a standard type opening which provides a clean unencumbered surface for contact by a consumer's mouth for drinking purposes. The vent aperture provides for the venting of any excess gas pressure present in the can prior to opening of the can. Furthermore, after opening of the container, no loose debris remains in the can.

Although several embodiments of the invention have been described herein in detail, the teachings of the present invention will suggest many other embodiments to those skilled in the art. For instance, although only two separately stored ingredients for a product are shown and described in the disclosed embodiments, it should be apparent to one skilled in the art that embodiments fall within the scope of the invention wherein three or more materials may be separately stored and automatically admixed upon or preceding opening of the container. Furthermore, although several types of convenience openers for the containers have been illustrated, other types of openers may be used in other embodiments or modifications of the invention.

What is claimed is:

1. A container arrangement for separately storing at least first and second materials in a container and providing for the selective admixing of the first and second materials in the container, said container including a substantially planar closure member having a dispensing orifice; container opening means being mounted on said closure member and having a surface portion sealingly closing said dispensing orifice; a compartment within said container for storing the first one of said materials; and means fastening said compartment to said closure member in alignment with said dispensing orifice, said opening means having said orifice sealing surface from one wall portion of said compartment whereby actuation of said container opening means to open said dispensing orifice causes said compartment to disengage from said sealing surface and said compartment fastening means to tilt said compartment into said container to thereby release the contents of said compartment into the second of said materials stored in said container.

2. An arrangement as claimed in claim 1, said compartment fastening means comprising a projection integrally formed with said compartment and fastened to said closure member; and means on said projection for tiltingly biasing said compartment into said container responsive to actuation of said opening means disengaging said container from said orifice sealing surface.

3. An arrangement as claimed in claim 1, comprising a venting aperture formed in said closure member, said venting aperture being normally sealed by said container opening means and adapted to be opened responsive to actuation of said opening means preceding opening of said dispensing orifice for venting excess pressurized gas from said container.

4. An arrangement as claimed in claim 1, said compartment comprising a cup-shaped receptacle, the rim of said receptacle being in sealing engagement with said sealing surface on said opening means.

5. An arrangement as claimed in claim 1, said container opening means comprising a pull-top opener.

6. An arrangement as claimed in claim 1, said container being essentially a cylindrical can having flat top and bottom closures.

7. An arrangement as claimed in claim 1, said container being formed of a metallic material.

8. An arrangement as claimed in claim 1, said compartment being formed of a plastic material.

* * * * *